United States Patent [19]

Goodson

[11] 4,198,836

[45] Apr. 22, 1980

[54] APPARATUS FOR DYEING TEXTILES

[75] Inventor: Sam M. Goodson, Walker County, Ga.

[73] Assignee: West Point Pepperell, Inc., West Point, Ga.

[21] Appl. No.: 15,670

[22] Filed: Feb. 27, 1979

[51] Int. Cl.[2] ..... D06B 1/02; D06B 11/00

[52] U.S. Cl. ..... 68/205 R; 118/301; 118/314

[58] Field of Search ..... 68/200, 205 R; 118/301, 118/314, 324, 325

[56] References Cited

U.S. PATENT DOCUMENTS

| | | | |
|---|---|---|---|
| 3,964,860 | 6/1976 | Leifeld | 68/205 R X |
| 4,010,709 | 3/1977 | Sayman et al. | 68/205 R X |

*Primary Examiner*—Philip R. Coe
*Attorney, Agent, or Firm*—James F. Davis

[57] ABSTRACT

Apparatus and method for dyeing carpets and the like in random patterns and multiple colors. Dye is applied in liquid streams from troughs having rollers and doctor blade scrapers. The troughs are arranged in pairs along the path of carpet movement, one trough in each pair being above the other trough of the pair. Dye streams from the pairs of troughs are broken up into droplets before contacting the carpet in such a way as to prevent substantial mixing of the streams prior to contact with the carpet. The particular arrangement of the trough pairs and dye streams results in a dyed carpet of high quality at a substantial savings in equipment cost and quantity of dye used.

4 Claims, 2 Drawing Figures

APPARATUS FOR DYEING TEXTILES

BACKGROUND OF THE INVENTION

This invention relates to the dyeing of textiles, such as carpets, and particularly to improved apparatus for dyeing such textiles in random patterns.

It is known that textiles, particularly carpets, dyed with a single color with varying tone patterns, or multiple colors, can produce very desirable visual effects. The effects are particularly attractive when the tone variations or different colors appear randomly on the carpet surface. Apparatus and methods for performing such dyeing are disclosed in U.S. Pat. Nos. 3,683,649, 3,731,503 and 3,964,860, and the present invention constitutes improvements in such apparatus and methods. In the apparatus and methods disclosed in the prior art, rollers immersed in troughs of dye are rotated to pick up a film of dye. The film of dye is scraped off the rollers by inclined doctor blades and the dye then flows down the inclined doctor blades through channels provided on the surface of the blades. In this way, the dye is formed into individual streams. The streams then flow vertically downwardly as a curtain of dye and strike a grid, moving fingers and/or stationary fingers which break up the stream into droplets. The droplets then fall onto a moving textile breadth below which is transported horizontally at a rate so as to give the desirable dye concentration, randomness, and density of the textile surface. To maintain random effect to the dyeing, the doctor blades and the grid or moving fingers are continually moved (by oscillation or rotation) so that the droplets do not form into repeating patterns.

In order to dye a textile breadth with several different dyes in one dyeing operation, e.g., four different dyes, it is necessary to provide multiple dye heads, that is to say, multiple units comprising a trough, roller and associated doctor blade, grid, moving fingers, etc. U.S. Pat. No. 3,964,860, noted above, teaches the use of multiple units arranged in serial fashion, each unit providing a separate dye color to the textile breadth and each unit comprising a complete assembly of trough, roller, doctor blade and associated droplet-producing parts (grids, moving fingers, etc.).

While such an arrangement can produce a multi-colored dyed textile product such as carpet which is satisfactory in visual effect, the arrangement is not desirable in operation for several reasons. First, it is expensive to provide complete multiple units for each dyeing application. Second, the individual dye head units are spaced so distant from one another in serial fashion along the direction of textile or carpet movement that there is an undesirable time lag between the application of the first dye and the last (e.g., the first dye and the fourth dye in a four-dye application). This time lag results in excessive penetration of the first-applied dyes into the backing of the textile or carpet where it is not visible and is wasted. This results in excessive and unnecessary use of dyes and makes the operation unnecessarily expensive. Third, the use of multiple individual units in serial fashion requires excessive linear floor space for the dye equipment.

SUMMARY OF THE INVENTION

It is therefore an object of this invention to provide improved apparatus for dyeing textiles, particularly carpets, with multiple dyes in random configurations.

A particular object of this invention is to provide apparatus for random dyeing of carpets wherein the dyeing is done economically by (a) reducing the amount of equipment necessary to effect multiple dyeing steps and (b) reducing the amount of dye necessary to obtain the desired visual effects on the surface of the carpeting.

A further object of this invention is to reduce the cost of dyeing carpet by multiple applications of different dyes in random configuration without at the same time reducing the quality of the visual effect produced by multiple dyeing.

The invention achieves the desired objects by providing an improved structure and orientation of the physical elements used for the dyeing. Troughs containing dyes, along with associated rollers and doctor blades, are arranged in pairs on a horizontal path along which the carpet to be dyed is passed. Each pair of troughs is capable of providing two different dye colors. One trough of each pair is placed above the other trough and is offset horizontally along the path of carpet movement a sufficient distance to prevent the mixing of downwardly-falling dyestreams. However, the troughs are sufficiently close so that the dyestreams from the troughs of each pair of troughs strike the same droplet-producing apparatus and thereafter the droplets strike the moving carpet surface at very close to the same time. By placing pairs of troughs near each other horizontally along the path of movement of the carpet, dyeing with multiple dyes is effected with a minimum of time lag between dye applications and with a minimum of dye loss through excessive penetration of dye to the carpet base. Despite the close distances of the dyestreams within each pair of troughs, the dyes do not mix to any appreciable extent prior to striking the carpet surface, and consequently the visual quality of the multiple dyeing is not adversely affected.

DETAILED DESCRIPTION OF THE INVENTION

Figure 1:
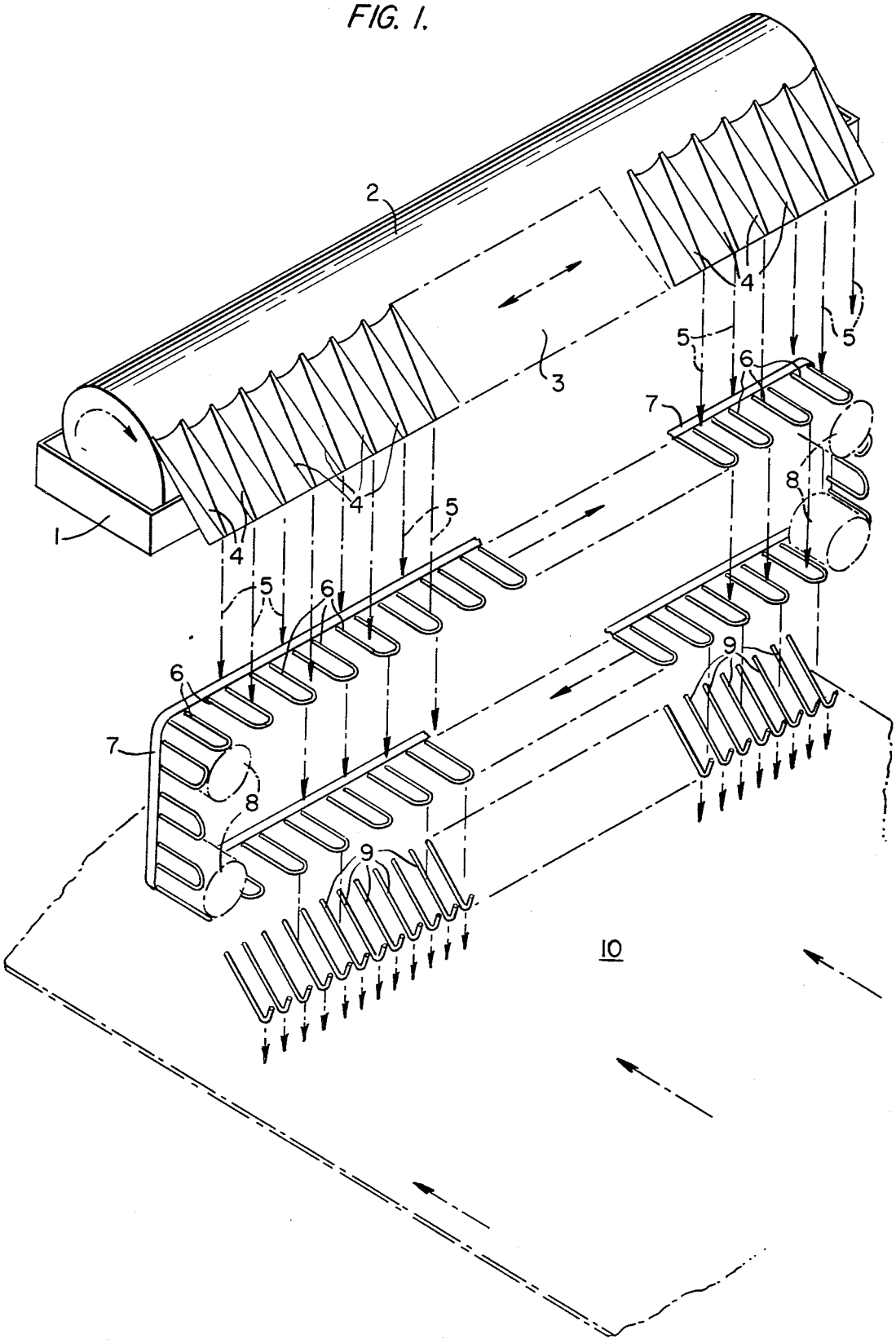
Figure 2:
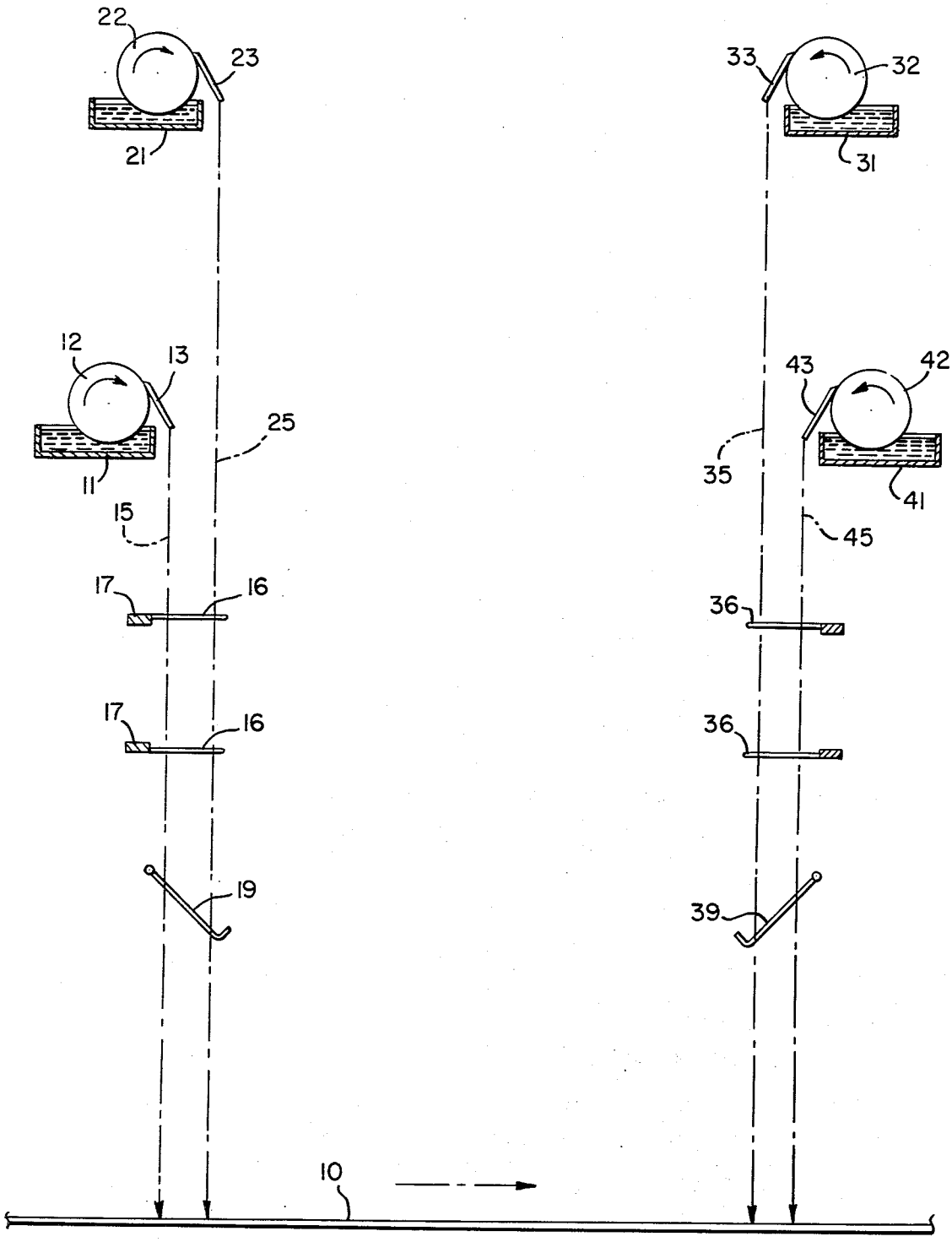

The invention will now be described in greater detail by reference to the accompanying drawings wherein:

FIG. 1 is a perspective view illustrating the principal components of the dyeing apparatus of the invention; and FIG. 2 is a diagram showing in side view the arrangement of two pairs of dyeing units according to the invention.

The embodiment of FIG. 1 shows the principal components of the apparatus of the invention. The components comprise a trough 1 into which dye is placed. Roller 2 is placed in the trough and is submerged at its lower part into the dye. Roller 2 is rotatable in a clockwise direction as indicated in FIG. 1 and is supported by housings and rotated by a drive motor (not shown) as conventionally disclosed in, e.g., U.S. Pat. No. 3,683,649. Doctor blade 3 is located adjacent the surface of roller 2 and is downwardly inclined. The top edge of doctor blade 3 is contiguous with roller 2 so as to scrape dye off the surface of roller 2 as the roller rotates. The top surface of blade 3 is provided with a series of V-shaped channels 4 by which the dye is directed into individual jets 5 to form a curtain of downwardly-flowing dye streams.

As the dye streams 5 fall vertically downward, they strike moving fingers 6 and are broken up into droplets. Fingers 6 are preferably U-shaped as illustrated in FIG. 1 but could also be of other configurations, such as V-shaped or simply straight. The width of the fingers (i.e., the distance from the top to the bottom of the U) is preferably between about 3 to 6 inches. Fingers 6 are attached to an endless belt 7 which revolves around guide rollers 8. Belt 7 is driven by conventional means such as an electric motor (not shown). It will be appreciated that the streams of dye 5 contact moving fingers 6 at two different vertical locations as the streams flow downward-first at the upper portion of the travel path of belt 7, as indicated by the arrow showing movement to the right of belt 7, and again at the lower portion of the travel path of belt 7, as indicated by the arrow showing movement to the left of belt 7. In this way, it is assured that the streams will be broken up into droplets during downward fall.

Below belt 7 and moving fingers 6 are a series of stationary fingers 9 which are located in the path of the downwardly falling droplets. As some of the droplets strike stationary fingers 9, they are directed onto the surface of the moving carpet 10 below. Fingers 9 are preferably oriented at an angle to the vertical and in a direction parallel to the direction of movement of carpet 10. As shown in FIG. 1, fingers 9 have upwardly-turned ends and are secured at their other ends to the base of the support structure for the dye head (not shown).

In operation, doctor blade 3 is oscillated back and forth as shown by the arrow in FIG. 1 by suitable electric motor drive means and gearing (not shown) in order to vary the position and volume of the dye in the resulting streams 5. Suitable means to provide oscillation is conventional and is illustrated in U.S. Pat. No. 3,683,649. At the same time, belt 7 is revolved at a rate suitable to ensure the breaking up of the dye streams into droplets. The rate of oscillation of doctor blade 3 and the rate of revolution of belt 7 can be adjusted to effect the desired production of droplets onto the carpet surface. A suitable blade oscillation rate is about 110 oscillations per minute, and a suitable revolution rate is about 10 feet per minute.

FIG. 2 shows diagramatically the arrangement of four dye troughs in accordance with the invention. Trough 11 and its associated roller 12 and doctor blade 13 are arranged to provide a first curtain of dye streams 15 falling from doctor blade 13. Such dye streams strike moving fingers 16 (comparable to fingers 6 of FIG. 1) which fingers are attached to an endless belt 17 (comparable to belt 7 of FIG. 1). The droplets thereby produced then strike stationary fingers 19 (comparable to stationary fingers 9 of FIG. 1) before striking the surface of moving carpet 10.

A second trough 21 which holds a second dye is placed above and slightly to the right (the direction of carpet movement) of trough 11. Roller 22 and doctor blade 23, in association with trough 21 and the second dye therein, produce a second curtain of dye streams 25 which falls in a plane parallel to the plane of dye stream 15 and strikes moving fingers 16 and stationary fingers 19 as shown in FIG. 2. Streams 15 and 25 are spaced far enough apart to prevent any mixing prior to striking fingers 16, preferably about ¾ to 2 inches apart. Test runs show that if the distance between the streams is so maintained, no substantial mixing of either the streams or the resulting dye droplets occurs, and the visual quality of the dyes on the carpet surface is comparable to that obtained by using dye heads with separate droplet-producing devices.

Referring again to FIG. 2, two additional troughs 31 and 41 are placed opposite troughs 21 and 11, respectively, and have associated rollers and doctor blades, 32, 33 and 42, 43, respectively. By using two additional different dyes in troughs 31 and 41, a four-dye system is created. Dye streams 35 and 45 are produced as before, and upon striking moving fingers 36 and stationary fingers 39 as shown, droplets are produced which strike the moving carpet 10.

To illustrate the advantages of the apparatus and methods of the invention, two comparative dyeing tests were made. The purpose of the tests was to compare the dyeing apparatus and methods of the present invention to apparatus and methods of the prior art, particularly as disclosed in the three U.S. patents earlier identified. In the first test, undyed carpet was run through and dyed in an apparatus built in accordance with FIG. 2 hereof but in a manner to simulate dyeing by separate dye heads arranged in series, as shown in FIG. 8 of U.S. Pat. No. 3,964,860. In particular, the first test consisted of dyeing a carpet sample in two runs. In the first run, the carpet was dyed only from troughs corresponding to troughs 11 and 31 of FIG. 2 containing different color dyes. Immediately thereafter, the carpet was run through the apparatus in a second run but dyed only from troughs corresponding to troughs 21 and 41 of FIG. 2 containing another two different dye colors. This double-run of the first test thus simulated a dyeing procedure in which four separate dyes are applied in serial fashion from troughs and droplet-producing apparatus which are separate from one another and which are located a substantial linear distance apart.

In the second test, the carpet was run through the apparatus only once, at the same linear rate as the first test, and all four dyes were applied during the run in accordance with the invention and as illustrated in FIG. 2. Upon comparing the dyed carpet samples, the following evaluation was made:

(a) The visual appearance of the surface of both carpet samples was substantially identical in depth of color, random distribution of color and discreteness of individual colors. This was true even though the dyes applied from troughs 11 and 21 and troughs 31 and 41, respectively, in the second test were applied substantially simultaneously in time and location. Quite unexpectedly, the close proximity of the dye streams within each pair of troughs, and the resulting opportunity for the mixing of the dye droplets before striking the carpet surface, caused no significant deterioration in the visual quality of the final dyed sample as compared to the sample dyed in accordance with the principles of the prior art. Thus, by operating in accordance with the invention, it is possible to create a product of equal quality but at substantially reduced cost by eliminating much of the duplicative hardware used in prior art devices.

(b) The carpet sample dyed in the first test (simulating prior art conditions) used significantly more dye than the carpet sample dyed in accordance with the present invention. Inspection of the carpet backing of the first sample showed that there had been substantial penetration of the dyes from troughs 11 and 31, particularly trough 11, to the backing of the carpet where it was wasted and unnecessary. On the other hand, the carpet sample dyed in accordance with the invention showed substantially less penetration of any dyes to the carpet base. It was estimated by visual appearance of the carpet backings that the sample dyed in accordance with prior art practices used 10–15% more dye than the sample dyed in accordance with the invention. Thus, to obtain comparable final products, the apparatus and methods of the invention used 10–15% less total dye, a substantial savings.

The particular embodiment and test examples of the invention described above are not intended to limit the scope of the invention to such disclosure and those skilled in the art will recognize that changes and modifications can be made within the scope of the invention. For example, additional pairs of dye troughs could be added to the systems as shown in FIG. 2 to provide for additional different dye applications. Also, if only two dyes are to be applied, a single pair of troughs could be used thus eliminating the duplicative drop-producing hardware used by two complete trough arrangements as in the prior art. Furthermore, by increasing the width of the drop-producing hardware (grids, fingers and the like), one could use additional troughs without adding separate drop-producing hardware, thus effecting even greater savings in multicolor dyeing processes.

Having disclosed the invention, I claim:

1. In an apparatus for the continuous dyeing of a moving textile breadth comprising a plurality of troughs for holding dye, a roller in each trough which roller rotates to form a dye film thereon, a doctor blade adjacent each roller for removing the dye film, means for directing said dye film on each doctor blade into streams of dye, and a plurality of means for breaking up said streams of dye into droplets the improvement wherein said troughs are arranged in pairs, each pair of troughs being spaced from each other pair of troughs in a direction parallel to the movement of the textile breadth and each pair of troughs having disposed beneath it one of said plurality of means for breaking up into droplets the streams of dye coming from each trough, the troughs of each pair being spaced apart vertically from one another and spaced apart horizontally from one another by a distance less than the width of the means beneath each pair of troughs for breaking up the streams of dye into droplets.

2. Apparatus of claim 1 wherein the means for breaking up said streams of dye into droplets includes an endless belt positioned below each pair of troughs, said belt having a plurality of fingers projecting therefrom in a direction the same as the movement of the textile breadth and said fingers being in vertical line with the streams of dye, said belt being adapted to revolve in a direction perpendicular to the movement of the textile breadth.

3. Apparatus of claim 2 wherein the means for breaking up said streams of dye into droplets further includes a plurality of stationary fingers located beneath the fingers of each endless belt and in vertical line with said streams of dye, said stationary fingers projecting in a directon parallel to the movement of the textile breadth.

4. Apparatus of claim 2 wherein the fingers projecting from said endless belt are of U-shape.

* * * * *